US007405715B2

(12) United States Patent
Guzman et al.

(10) Patent No.: US 7,405,715 B2
(45) Date of Patent: Jul. 29, 2008

(54) LED LIGHT APPARATUS WITH INSTANTLY ADJUSTABLE COLOR INTENSITY

(76) Inventors: Robert G. Guzman, 11274 Goss St., Sun Valley, CA (US) 91352; Manuel Hugo Rojas Moscopulos, Juan XXIII #6168 Departamento 30, Vitacura-Santiago (CL)

( * ) Notice: Subject to any disclaimer, the term of this patent is extended or adjusted under 35 U.S.C. 154(b) by 491 days.

(21) Appl. No.: 10/486,079

(22) PCT Filed: Aug. 9, 2002

(86) PCT No.: PCT/US02/25299

§ 371 (c)(1),
(2), (4) Date: Feb. 5, 2004

(87) PCT Pub. No.: WO03/015067

PCT Pub. Date: Feb. 20, 2003

(65) Prior Publication Data

US 2005/0040772 A1 Feb. 24, 2005

Related U.S. Application Data

(60) Provisional application No. 60/311,200, filed on Aug. 9, 2001.

(51) Int. Cl.
*G09G 3/32* (2006.01)
*G09G 5/00* (2006.01)
*G09G 5/02* (2006.01)

(52) U.S. Cl. ..... 345/83; 345/211; 345/593; 345/594; 315/293; 362/84; 362/85

(58) Field of Classification Search ..... 345/1.1–1.3, 345/2.1–2.3, 208, 211, 214, 690, 83, 589–594; 315/200 R, 293, 302, 313, 314; 362/84, 362/85

See application file for complete search history.

(56) References Cited

U.S. PATENT DOCUMENTS

| | | | | |
|---|---|---|---|---|
| 3,740,570 | A | | 6/1973 | Kaelin et al. |
| 4,298,869 | A | * | 11/1981 | Okuno ..... 345/82 |
| 4,845,481 | A | | 7/1989 | Havel |
| 4,962,687 | A | * | 10/1990 | Belliveau et al. ..... 84/464 R |
| 4,965,561 | A | | 10/1990 | Havel |
| 5,739,809 | A | * | 4/1998 | McLaughlin et al. ..... 345/594 |
| 5,752,766 | A | | 5/1998 | Bailey et al. |
| 5,803,579 | A | | 9/1998 | Turnbull et al. |
| 5,896,010 | A | | 4/1999 | Mikolajczak et al. |
| 5,900,850 | A | | 5/1999 | Bailey et al. |
| 6,016,038 | A | | 1/2000 | Mueller et al. |
| 6,127,783 | A | | 10/2000 | Pashley et al. |
| 6,140,778 | A | | 10/2000 | Pringle et al. |
| 6,149,283 | A | | 11/2000 | Conway et al. |
| 6,150,774 | A | | 11/2000 | Mueller et al. |

(Continued)

*Primary Examiner*—Henry N Tran
(74) *Attorney, Agent, or Firm*—Christie, Parker & Hale, LLP

(57) ABSTRACT

An instantly controllable LED light apparatus provides an LED array (34) formed of red, green and blue LEDs in a regular arrangement. The apparatus also provides a unitary power supply/controller (4) disposed within a unitary housing (20) that is coupled only to the LED array (34) and a power source (56) in one embodiment. The power supply/controller (4) includes a memory device (64) such that, when a button (62) is pressed on the control panel (18) of the power supply/controller (4), a desired illumination color is instantly produced by the combination of the red, green and blue LEDs of the LED array (34).

6 Claims, 11 Drawing Sheets

U.S. PATENT DOCUMENTS

| | | | |
|---|---|---|---|
| 6,166,496 | A | 12/2000 | Lys et al. |
| 6,183,086 | B1 | 2/2001 | Neubert |
| 6,184,628 | B1 | 2/2001 | Ruthenberg |
| 6,196,471 | B1 | 3/2001 | Ruthenberg |
| 6,255,786 | B1 | 7/2001 | Yen |
| 6,340,868 | B1 | 1/2002 | Lys et al. |
| 6,351,079 | B1 | 2/2002 | Willis |
| 6,369,525 | B1 | 4/2002 | Chang et al. |
| 2002/0047646 | A1 | 4/2002 | Lys et al. |
| 2002/0057061 | A1 | 5/2002 | Mueller et al. |

* cited by examiner

LED LIGHT APPARATUS WITH INSTANTLY ADJUSTABLE COLOR INTENSITY

CROSS-REFERENCE TO RELATED APPLICATIONS

This application is the national stage of PCT/US02/25299 filed 9 Aug. 2002 which claimed the benefit of U.S. Provisional Application 06/311,200 filed on 9 Aug. 2001.

FIELD OF THE INVENTION

The present invention relates, most generally, to an apparatus and method for generating light for illumination or display purposes using an LED system. More particularly, the present invention relates to an instantly controllable LED light apparatus.

BACKGROUND OF THE INVENTION

Conventional light sources, such as used for illumination and display purposes in the entertainment and other industries, typically use a white light source. These light sources work on the principle that white light carries the full spectrum of visible rays of light having various wavelengths and associated colors. In conventional lighting systems, the light source is not directly controlled to provide various colors but, instead, filters, gels, and dichroic glass are used in conjunction with the white light source to color the visible illumination. Dichroic light systems include a white light source and red, green, and blue filters and involve a combination of 3 to 4 light sources or mechanical devices to mix colors. Gels and filters are colored transmissive materials placed over the white light source to produce colored illumination. As such, when different colors of light are desired, the filters, gels or dichroic glass that cover the white light source, must be mechanically changed. This is a time consuming process. The different gels, etc. used to provide the different colors of light may include the primary colors of red, green and blue, and the combinations thereof such as the secondary colors of magenta, cyan, and yellow, as well as the different white light colors conventionally designated in terms of Kelvin degrees (° K).

Other available lighting systems use many, different colored LEDs (light emitting diodes), in combination, to produce various colors of visible illumination. Such systems typically require multiple connections such as to both a power supply and a separate controller such as a computer. As such, these multiple component systems are rather bulky with decreased portability. Many LED lighting systems also include dip switches or other settings that must be physically adjusted in order to select and control the colors produced by the LED light source. Such a requirement to physically toggle switches in order to change colors, is labor intensive and time consuming. Therefore, the various different colors of illumination cannot be selected or changed in an instant.

It would therefore be advantageous to provide an LED lighting apparatus that is lightweight and portable and operates using a minimal number of components. More particularly, it would be advantageous to provide such an apparatus with a single power supply/controller and which can have the illumination color and intensity selected and switched instantly by the press of a button. The present invention addresses these needs.

SUMMARY OF THE INVENTION

To achieve these and other objects, and in view of its purposes, the present invention is directed to providing light of a selectable color using LEDs (light emitting diodes) and other light sources. In one embodiment, the present invention provides a lighting apparatus comprising a plurality of LEDs and an integral power supply/controller disposed within a unitary housing and coupled only to the plurality of LEDs and a power source. The power supply/controller includes a power supply module, a memory device, a user interface and a controller. The power supply module receives power from a power source, modulates the power and provides modulated power to the plurality of LEDs. The user interface has a plurality of pre-set buttons, and the controller receives a signal from each of said pre-set buttons and communicates with the memory unit and the power supply module to instantly cause the plurality of LEDs to produce an illumination color.

BRIEF DESCRIPTION OF THE DRAWING

The present invention is best understood from the following detailed description when read in conjunction with the accompanying drawing. It is emphasized that, according to common practice, the various features of the drawing are not to scale. On the contrary, the dimensions of the various features are arbitrarily expanded or reduced for clarity. Like numbers denote like elements throughout the figures and specification. Included in the drawing are the following figures.

DETAILED DESCRIPTION OF THE INVENTION

Figure 1:
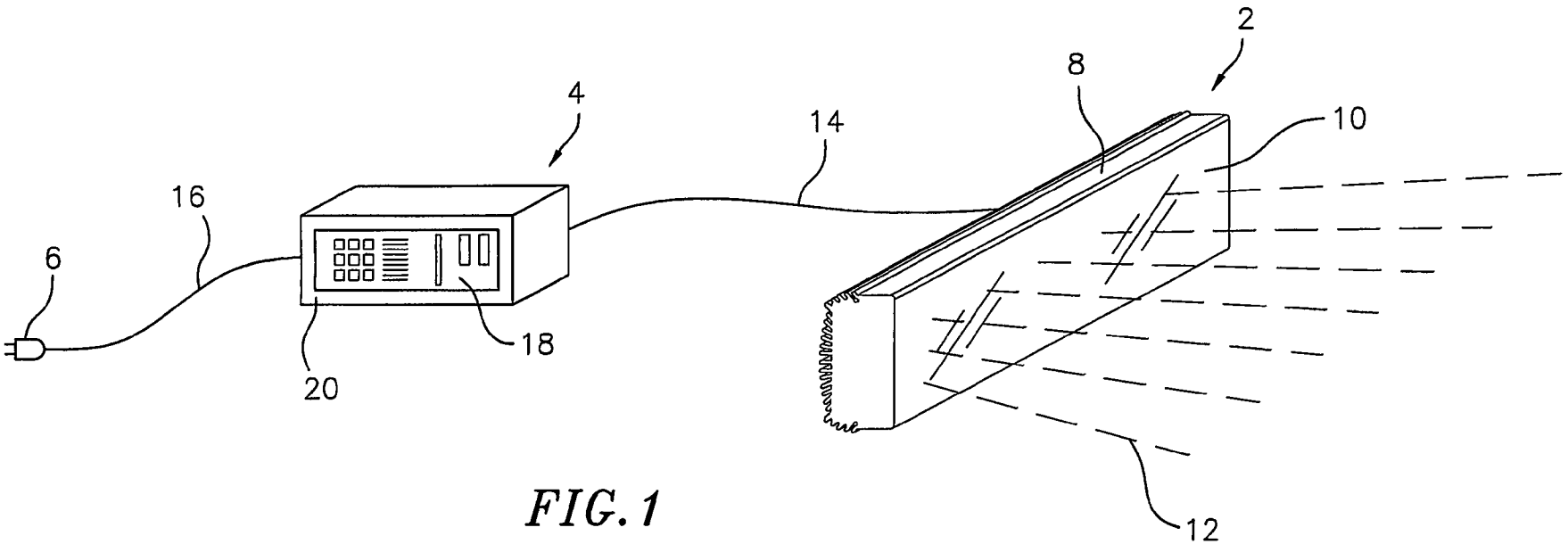
FIG. 1 is a perspective view showing an exemplary LED light apparatus of the present invention.

The present invention provides multiple colors of visible illumination without filters, gels, moving parts, or a combination of various mechanical lighting devices. Unlike many conventional light sources, the present invention does not use white light as its basic illumination source. In one embodiment, the multiple colors of visible illumination are produced by an array of multiple colored LEDs. The present invention saturates the array with colors to produce a multitude of different visible colors which are perceivable to the naked eye, color film, digital tape, and videotape. The present invention can be used to provide the primary lighting on a movie set, for example, or it may be used to compensate and adjust for ambient light which may already be present. The light source of the present invention is compatible with the various films used in the entertainment, and other film industries.

The LED array may be controlled by a single power supply/controller, and the illumination color can be instantly selected and produced by the push of a button. The power supply/controller includes a power supply to modulate power from the power source, and an illumination control unit including a memory device. The illumination produced by the LED array can be selected and switched instantly without having to access a computer or to physically set dip switches or other physical settings associated with the power supply/controller.

In one embodiment, the light source includes an array of LEDs of the primary colors of red, blue, and green. Various combinations of individual color intensities of the red, blue and green LEDs are used to provide a multitude of different visible illumination colors, including the primary colors of red, green and blue, a multitude of combinations thereof, including the secondary colors of magenta, cyan and yellow, and the various white light colors such as 5500°0 K (sunlight, or daylight), 3200° K (tungsten) and 2900° K, such as used in the motion picture industry. The exemplary LED array is saturated with the basic colors of red, blue and green which combine to produce the various visible illumination colors. In other embodiments, light sources other than LEDs may be used. The light apparatus of the present invention can advantageously be used to recreate any color such as appears in a conventional gel swatch book, for example. The user may create a customized color of their choice, or the color may be used in conjunction with ambient light to produce a final illumination color.

The visible colors can be selected and changed instantly using a pre-set button of the control panel formed on the power supply/controller. A pre-programmed color stored in the memory device of the control unit, can be instantly selected by the press of such a pre-set button. The memory unit preferably contains a plurality of pre-set illumination colors which can be custom set at the factory prior to installation in the power supply/controller. In an alternative embodiment, remote control may be used and the power supply/controller can be controlled by an optional external computer in which a multitude of various other colors can be selected and produced, rather than a command from the pre-set buttons on the control panel. The integral power supply/controller unit advantageously provides portability to the LED light apparatus, which finds advantageous application in the motion picture and related industries in which different lighting requirements are required in rapid succession. Only the LED array and a single power supply/controller unit (and a power source) are needed to instantly produce various illumination colors.

FIG. 1 shows an exemplary controllable color/intensity LED light apparatus of the present invention. More particularly, FIG. 1 shows LED unit 2 and power supply/controller 4. In the illustrated embodiment, power supply/controller 4 is only connected to LED unit 2 by means of electrical wire 14 and to plug 6 for receiving input (wall) power, by means of electrical wire 16. Electrical wire 16 may include a detachable power cord. LED unit 2 includes LED housing 8 and lens 10, and an LED array (not shown) contained within LED housing 8 produces visible illumination, light 12. Power supply/controller 4 is disposed within housing 20 that includes control panel 18. Multiple colors of visible illumination can be instantly produced by LED unit 2 by the press of a pre-set button on control panel 18 (shown in greater detail in FIG. 8). Further external connections are not needed. Physical settings on power supply/controller 4 or LED unit 2, are also not needed. In one exemplary embodiment, power supply/controller 4 includes a switching power supply, a control unit which may be a control board, a memory device, and a dimmer, as will be shown in FIGS. 6 and 7. The control unit in the power supply/controller 4 is capable of receiving a command (signal) from each of the pre-set buttons and communicating with the memory unit and power supply module, each within power supply/controller 4, to cause the LED array in LED unit 2, to produce a visible illumination 12 of a desired color. In the illustrated embodiment, an external control device such as a computer, is not needed to cause the LED unit to produce light of the desired color.

Housing 20 may be of various dimensions. In one exemplary embodiment, housing 20 may have the dimensions of 7⅞"×2½"×5½", but such is intended to be exemplary only, and housing 20 may include various other dimensions. Housing 20 is portable and lightweight and will weigh less than 3 pounds according to an exemplary embodiment. Housing 20 may be a hand-held unit and may include ventilation fins that extend from the housing to act as a heat sink.

Figure 2:
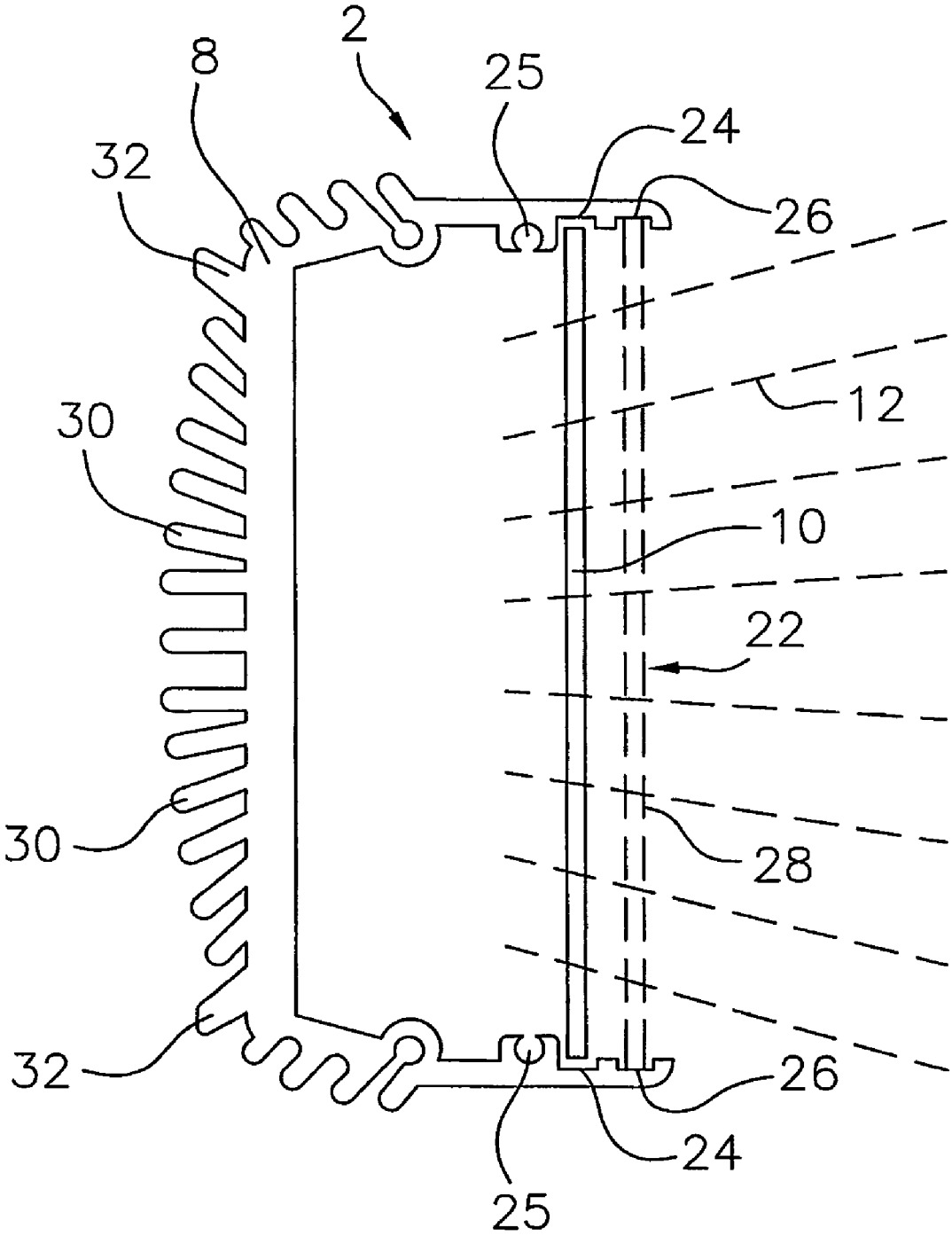
FIG. 2 is a cross-sectional view showing an exemplary LED housing for an LED array, according to the present invention.

FIG. 2 is a cross-sectional view showing an exemplary LED housing 8 for retaining an LED array (not shown). LED housing 8 may be formed of extruded aluminum according to one exemplary embodiment. According to other exemplary embodiments, other materials and other techniques of formation may be used. LED housing 8 includes open face 22 through which visible illumination 12 is projected. LED housing 8 also includes opposed grooves 24 for holding lens 10. Lens 10 may be formed of a glass or plastic or other suitable clear or translucent materials. In one embodiment, lens 10 may be a frosted Plexiglas diffuser. In another embodiment, lens 10 may be a diffuser formed of a holographic material that bends the different components of visible light in different directions as light passes through the lens. Grooves 25 and grooves 26 each form further accessory holders. Grooves 25 may also act as receptacles to receive screws to secure an end plate (see FIG. 12) to LED housing 8. LED housing 8 may optionally include a further accessory received in either or both sets of grooves 25 and 26. For example, see further accessory 28, shown in dashed lines as received by grooves 26. Further accessory 28 may be gel frame, a reflector, a further lens, or other accessories used to condition the illumination. LED housing 8 also includes fins 30 which act as a heat sink. Ribs 32 allow LED housing 8 to be retained by a holder (shown in FIGS. 11 and 12) with respect to which LED housing 8 may be slidable. The longitudinal configuration of fins 30 is intended to be exemplary only and other configurations and arrangements may be used in other embodiments.

Figure 3:
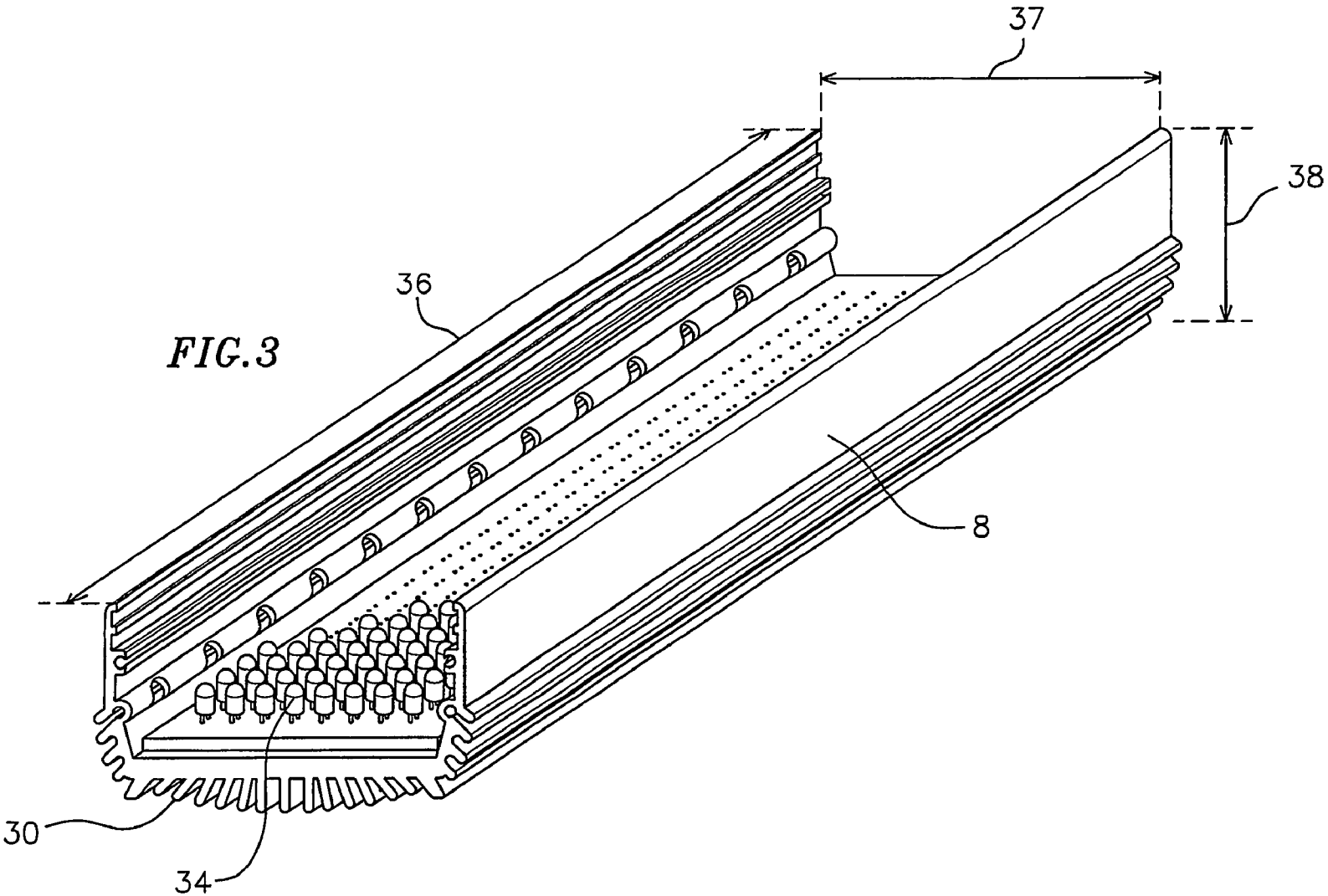
FIG. 3 is a perspective view showing a partial LED array within an LED housing according to the present invention.

FIG. 3 is a perspective view of LED housing 8 and shows a portion of LED array 34 disposed within LED housing 8. In an exemplary embodiment, LED housing 8 may include length 36 ranging from 6 to 96 inches, width 37 ranging from 2 to 8 inches, and depth 38 ranging from 1 to 8 inches. According to one exemplary embodiment, width 37 may be 2.75 inches and depth 38 may be 1.5 inches. It should be understood that such dimensions are intended to be exemplary only and not restrictive of the LED housing according to the present invention. The weight of the LED housing 8 may be on the order of 1-2 pounds or less and the relatively compact size and modular configuration of LED housing 8 allows it to be used in tight quarters while the lightweight aspect of the LED housing 8 allows it to be easily adjusted and positioned.

Figure 4:
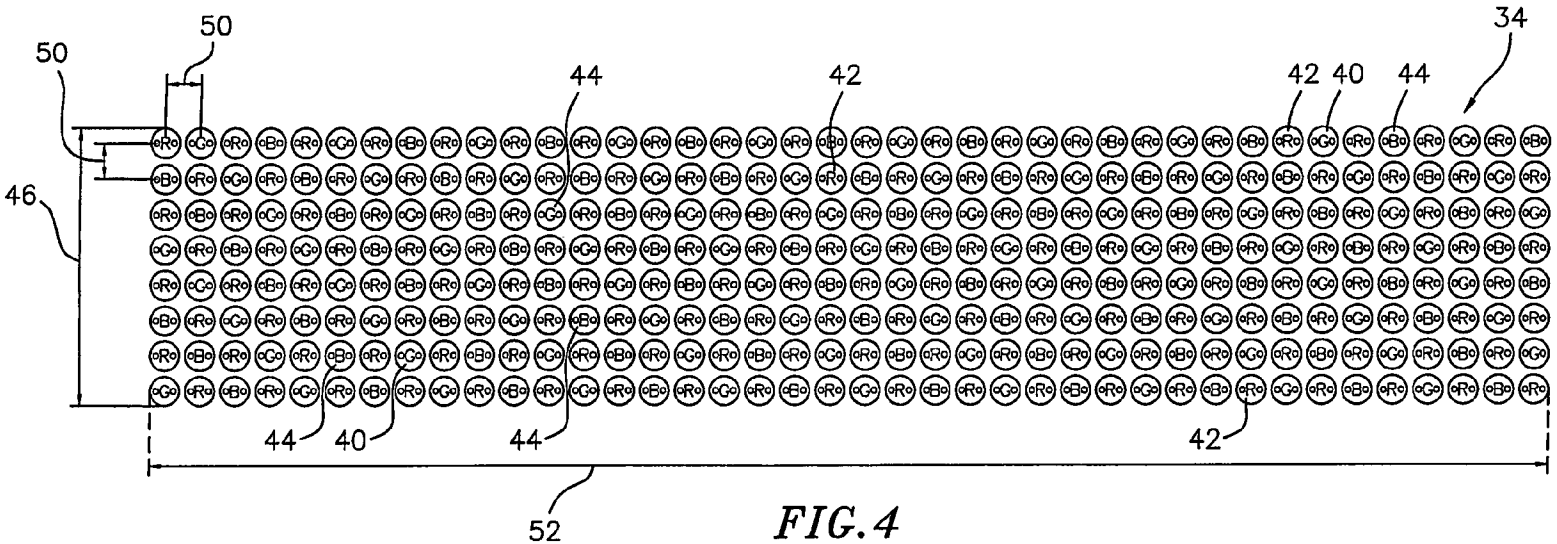
FIG. 4 shows an exemplary LED array according to the present invention.
Figure 5:
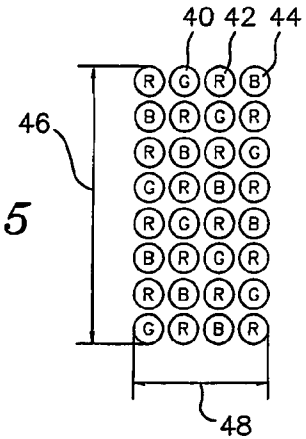
FIG. 5 shows a basic matrix according to one LED array embodiment of the present invention.

FIG. 4 is a plan view showing an exemplary LED array of the present invention. LEDs are advantageously used because of their quick response time attributable to the absence of a filament. LED array 34 functions as the controllable light source capable of producing multiple colors of visible illumination. The basic matrix of LED array 34, such as shown in FIG. 5, consists of a repeating sequence of diagonal lines of red/blue/red/green. Each column, then, includes a repeating sequence of red/blue/red/green. There are two red LEDs ("R", 42) for each green LED ("G", 40), and blue LED ("B", 44), a ratio of 2:1:1 red:green:blue. The higher number of red LEDs 42 is advantageously used to provide the correct daylight color temperature and other colors which are advantageously used in the motion picture industry, among other uses. In one exemplary embodiment, width 48 of the basic matrix of the LED array of the present invention, may be 27 millimeters, but other widths may be used in other exemplary embodiments. Similarly, in an exemplary embodiment, height 46 of LED array 34, may be on the order of 55 millimeters, but other heights may be used in other exemplary embodiments. Width 48 and height 46 of the basic matrix will vary, in other embodiments, depending on the number, size and spacing of the LEDs used to form the array.

The exemplary array shown in FIG. 4, includes a total of 320 LEDs: 160 red LEDs 42; 80 green LEDs 40; and 80 blue LEDs 44. It should be understood that such is intended to be exemplary only, and that other ratios of red/green/blue LEDs may be used alternatively. In an exemplary embodiment, the pitch 50 between adjacent LEDs may be 7 millimeters, but other pitches may be used in other exemplary embodiments. Also in an exemplary embodiment, LED array 34 consisting of 8×40 individual LEDs may include height 46 of 55 millimeters and length 52 of 279 millimeters, but such are intended to be exemplary only. LED arrays with various numbers of LEDs in various arrangements and with various array sizes, may be used in other exemplary embodiments. In still other exemplary embodiments, light sources other than LEDs may be used and arranged in various array configurations.

According to another exemplary embodiment, LEDs of colors other than red, green or blue may be used alternatively or additionally in the LED array. For example, another exemplary LED array may include red, green, blue and white LEDs. Various combinations and arrangements of the red/blue/green/white LEDs may be used to form the array. Multiple groups of variously colored LEDs may be used in other embodiments. Moreover, the illustrated embodiment showing red, green and blue LEDs may be varied such that different relative numbers of the various LEDs may be used, and they may be organized in different regular or random arrangements.

According to an exemplary embodiment, each LED may include a 15° lens, but other lenses may be used in other exemplary embodiments. According to one exemplary embodiment, the following model LEDs may be used: Red—Hewlett Packard Model No. HLMP-ED18-UX00; Green—Nichia America Model No. NSPG 500S; and Blue—Nichia America Model No. NSPB 500S. These LEDs are advantageous for their high power and intensity levels, but are intended to be exemplary only, and other LEDs may be used according to other exemplary embodiments.

According to the exemplary embodiment as shown in FIG. 4, the 160 red LEDs 42 may include 16 series of 10 red LEDs connected in parallel; the 80 green LEDs may consist of 16 series of 5 green LEDs connected in parallel; and the 80 blue LEDs may consist of 16 series of 5 blue LEDs connected in parallel. Other arrangements may be used in other exemplary embodiments.

According to other exemplary embodiments, light sources other than light emitting diodes (LEDs) may be used. The alternative light sources may be arranged in arrays and selected and controlled as described in conjunction with the LED embodiment. For specificity and clarity, the invention will continue to be described in terms of the red/green/blue LED array embodiment illustrated in FIG. 4, although the LED array may be formed using various other color combinations and configurations, as above.

The power supply/controller of the present invention controls each of the three primary colors of red, green and blue at 256 different intensity levels for each color. In this manner, 16.7 million color variations may be achieved. The 256 different intensity levels correspond to the 256 different current levels that the controller /power supply provides to the respective groups of the red, green and blue LEDs. The 256 current levels are achievable as a result of 8-bit data. Included among the 16.7 million colors capable of being produced by the exemplary red/green/blue LED array shown in FIG. 4, are the primary colors of red, blue, green and combinations thereof, including the secondary colors of yellow, cyan and magenta. Also included among the colors producible are the various white light colors including 5500° K, 3200° K, 2900° K, and intermediate white light colors therebetween.

Figure 6:
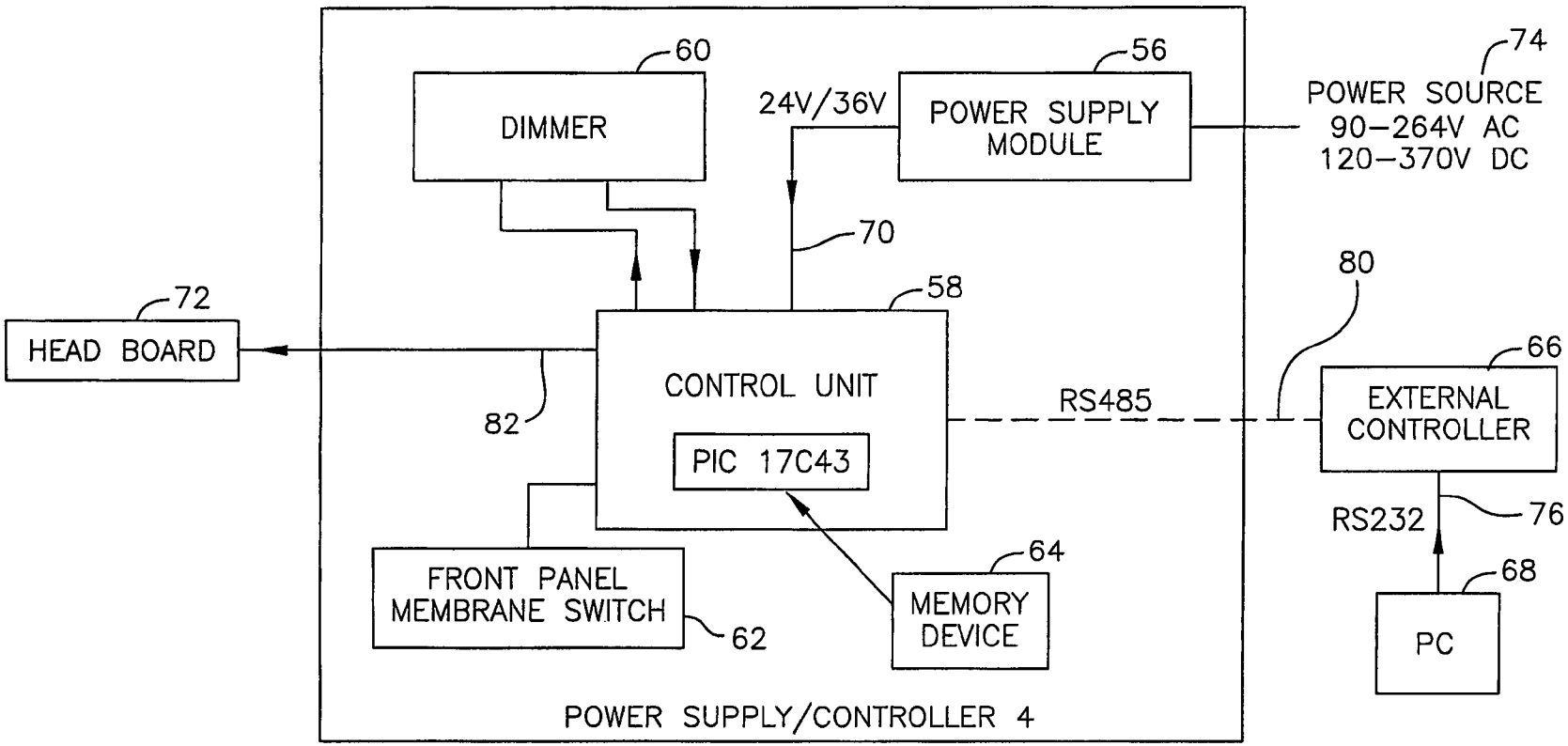
FIG. 6 is a schematic diagram of an exemplary LED lighting apparatus according to the present invention.

FIG. 6 is a schematic diagram of the LED lighting apparatus of the present invention. FIG. 6 shows power supply/controller 4 including illumination control unit 58, memory device 64, power supply module 56, dimmer board 60 and front panel membrane switch 62. It should be understood that the various components described, are part of power supply/controller 4 which is an integral unit preferably formed within a unitary housing such as housing 20 shown in FIG. 1. Control unit 58 may be a control board in one embodiment, and the terms may be used interchangeably hereinafter. Power source 74 is external input power. In one embodiment, power source 74 may be wall power and may range from 90-264 volts AC or 120-370 volts DC. Power supply module 56 may advantageously be a digital, switching power supply that works within the range of 90-264 volts AC and modulates the AC input power received from power source 74. In one embodiment, power supply module 56 may advantageously work within the range of 120-370 volts DC to modulate input DC power. In one embodiment, power supply module 56 regulates AC or DC input power from power source 74 to 24 volts DC. In another exemplary embodiment, power supply module 56 may regulate the input power from power source 74, to 36 volts DC. Power supply module 56 operates at a maximum draw of 0.25 amps at 120 volts AC. The illustrated power supply/controller 4 is a single, integral unit such as may be formed within a single housing such as housing 20 shown in FIG. 1. Power supply module 56 modulates power and provides current to head board 72 in accordance with control unit 58. Control unit 58 is coupled to power supply module 56, dimmer 60, front panel membrane switch 62, head board 72 and includes memory device 64 in the illustrated embodiment. In one exemplary embodiment in which control unit 58 is a mother board, power supply module 56 may be disposed on the mother board (control unit 58).

Front panel membrane switch 62 includes multiple pre-set buttons corresponding to multiple desired colors of visible illumination. When a pre-set button of front panel membrane switch 62 is selected, a command/signal is sent to control unit 58 which communicates with memory device 64 and power supply module 56 to produce the desired illumination color, that is, the desired combination of color intensities of the various different color groups of LEDs of LED array 34, to produce the selected output of visible illumination color. The LEDs of the LED array are advantageously controlled by amperage, not voltage. Responsive to the selection by the pre-set button on front panel membrane switch 62, power supply/controller 4 sends signals 82 to head board 72. The signals 82 separately control the intensity of each of the three basic colors of red, blue and green to 256 different intensity values for each color by using a corresponding plurality of different current levels. Headboard 72 is included within LED housing 8 (see FIG. 1) to receive signals and illuminate the respective LEDs in accordance with the intensity level of the LED group corresponding to the current level of signal 82. The LED array receives multiple signals 82, which may be a 24 volt signal in which the current values are varied to produce different intensity levels, using pulse width modulation. It should be understood that front panel membrane switch 62 is intended to be exemplary, not restrictive of the various selectors that may be used to send a command to control unit 58.

Memory device 64 may be any of various memory chips available, and in one embodiment may include nine color pre-set values. The color pre-sets stored within memory device 64 may be customized by the user and set prior to installation within power supply/controller 4. When a color is selected using a button of front panel membrane switch 62, an aspect of the present invention is that the selected color is produced substantially instantly. Therefore the visible illumination color of the LED light source may be switched instantly.

Power supply/controller 4 also includes dimmer 60. Dimmer 60 may be controlled by a dimmer switch (see FIG. 8), and in one embodiment includes three potentiometers ganged together to control the intensity of the output illumination. In another exemplary embodiment, dimmer 60 may be a linear digital dimmer including 100 steps. Each step may include 3 different values that correspond to the three different colored groups of LEDs. Dimmer 60 uniformly increases or decreases the intensity of the illumination of each of the selected colors by the same proportionate amount, according to one exemplary embodiment. In this manner, the visible illumination color, defined by the relative intensity values of each of the red, green and blue LEDs, and therefore indicative of the ratios of these primary colors, may remain unchanged but have its overall intensity adjusted by the dimmer. By adjusting the dimmer switch (FIG. 8), the dimmer can adjust the overall intensity substantially instantly.

According to the above described embodiment, the colors of illumination are produced substantially instantly by the power supply/controller 4 which is only connected to the LED array and a power source. In this embodiment, the control unit is controlled by the pre-set button on the control panel and communicates only with the front control panel, memory device and power supply module, to provide the illumination color.

According to another exemplary embodiment, the power supply/controller 4 of the present invention may be controlled using either an optional external connection or the pre-set buttons integral with the control panel. This is also shown in FIG. 6 which includes dashed line 80 indicating coupling and communication with external controller 66. The unit may then operate in remote control mode, in which the commands from the buttons of front panel membrane switch 62 are overridden by the external remote control. Power supply/controller 4 of the present invention is compatible for communication using standard DMX protocol (DMX-512 USITT 1990) and networks, as conventional in the professional lighting industry, such as which use RS-485 communication standards and an XLR5 connection. In an exemplary embodiment, control board 58 receives commands from external controller 66 using RS-485 communication standards. External controller 66 may be any of various computer systems and/or control light boards. In one exemplary embodiment, external controller 66 may be an RS-232 to RS-485 converter coupled to a personal computer 68. According to this exemplary embodiment, personal computer 68 communicates using RS-232 standards and provides signal 76. External controller 66, functioning as RS-232 to RS-485 converter 66, converts the RS-232 signal from personal computer 68 to an RS485 signal, which communicates and sends data to control unit 58 when power supply/controller 4 is in remote control mode.

When control unit 58 receives this external data signal (80), it communicates with power supply module 56 to provide current signals 82 of the appropriate current levels to illuminate the various groups of different colored LEDs of the LED array at corresponding intensity levels so as to produce the desired illumination color.

Figure 7:
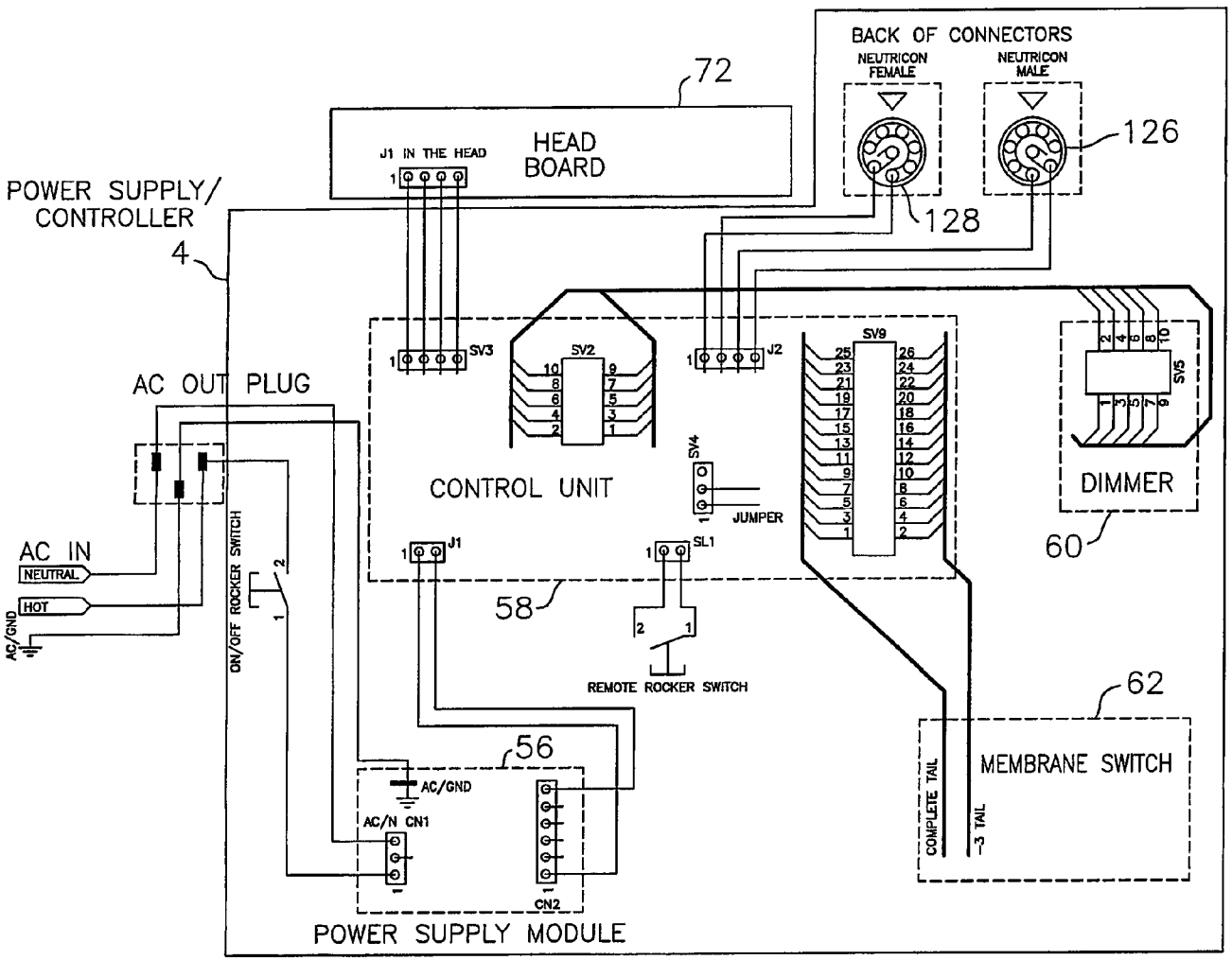
FIG. 7 is a wiring diagram of an exemplary power supply/controller of the present invention.

FIG. 7 is a wiring diagram showing the components of power supply/controller 4. In this embodiment, the memory storage device is within control unit 58. The reader is reminded that like numerals denote like features throughout the specification and drawings. FIG. 7 also includes data input port 126 and data output port 128 to provide connection to an external component, such as a computer. In the exemplary embodiment, data input port 126 and data output port 128 are each eight-pin connectors. Such is exemplary only. A conversor (not shown) may be used to condition the signal from the computer or other DMX communication, for compatibility with power supply/controller 4. Components control unit 58 and power supply module 56 are shown as separate blocks for the purpose of illustrating the wiring connection therebetween, but the power supply module 56 may be disposed directly on control unit 58 which may be a control board, in one embodiment.

Figure 8:
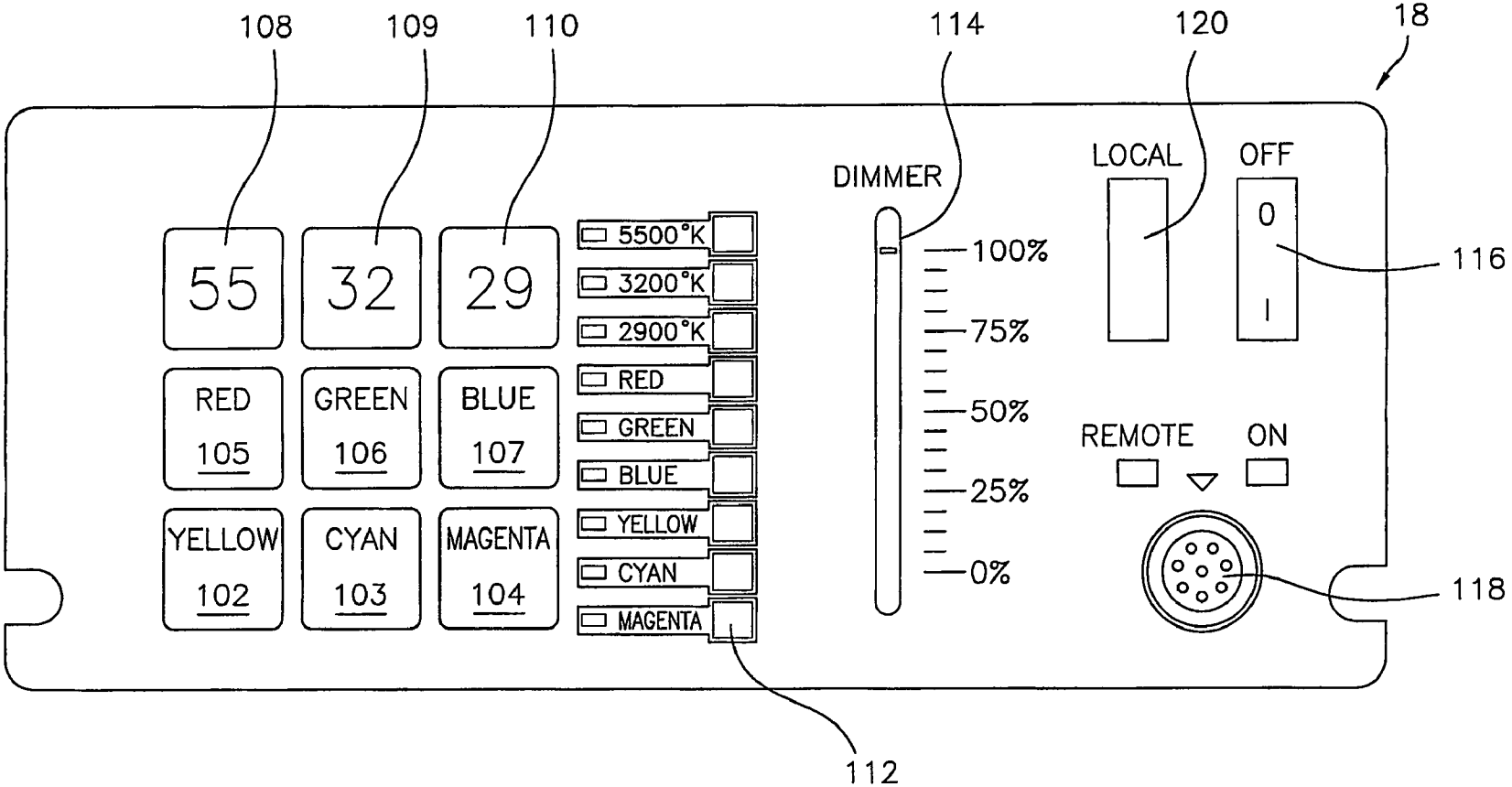
FIG. 8 is a plan view of an exemplary control panel for the power supply/controller of the present invention.

FIG. 8 shows an exemplary control panel such as may be used on housing 20 of power supply/controller 4. Control panel 18 includes nine pre-set buttons 102-110 in the illustrated embodiment, but various other numbers of pre-set buttons may be used in other exemplary embodiments. In an exemplary embodiment, a membrane switch is used such that when one of pre-set buttons 102-110 is pressed, a command/signal is sent to control unit 58 which communicates with power supply module 56 and memory device 64 to produce the selected color by sending the appropriate current signals to head board 72 of LED unit 2. Each pre-set button 102-110 corresponds to a pre-set color. In one exemplary embodiment, the pre-set colors may include red, green, blue, yellow, cyan, magenta and white light color of 5500° K, 3200° K and 2900° K. Such colors are intended to be exemplary only and according to other exemplary embodiments, control panel 18 may include more or less than nine pre-set buttons 102-110, and the pre-set buttons may correspond to various different colors pre-programmed onto memory storage unit 64 and instantly selectable by pressing the appropriate button. Also included on control panel 18 are indicators 112, each of the nine indicators 112 corresponding to one of the buttons 102-110. Indicator 112 becomes illuminated such as by an LED or other light, to indicate which of buttons 102-110 has been selected. Control panel 18 also includes dimmer switch 114, which controls dimmer 60 shown in FIGS. 6 and 7, and includes graduated intensity values of 0% to 100%. The color of visible illumination may be chosen in conjunction with the ambient light to compensate for the ambient light and/or to produce a composite illumination scheme.

Control panel 18 includes on/off switch 116 and local/remote switch 120. Local/remote switch 120 is switched to local when control panel 118 controls the LED apparatus and may be switched to remote position when an external unit such as an optional computer is used to control the LED unit. Each of on/off switch 116 and local/remote switch 120 may include LED indicators. Remote control mode may also be utilized in one exemplary embodiment in which several LED light apparatuses are connected in parallel. One apparatus may be designated the controlling apparatus and operate in local control mode (master), while all other apparatuses (slaves) are set in remote control mode and controlled by the controlling unit.

Still referencing FIG. 8, connector port 118 provides connection between power supply/controller 4 and the LED array. In one exemplary embodiment, the connection between the LED array and the power supply/controller is advantageously provided by an 8 pin connector in which four of the pins of the connector are live. In this exemplary embodiment, the four live pins include controls for the red, green and blue LEDs, as well as a ground. Other arrangements may be used in other exemplary embodiments. The unique 8 pin connector is advantageously used to prevent connection to the power supply/controller by entities other than the LED array.

Figure 9:
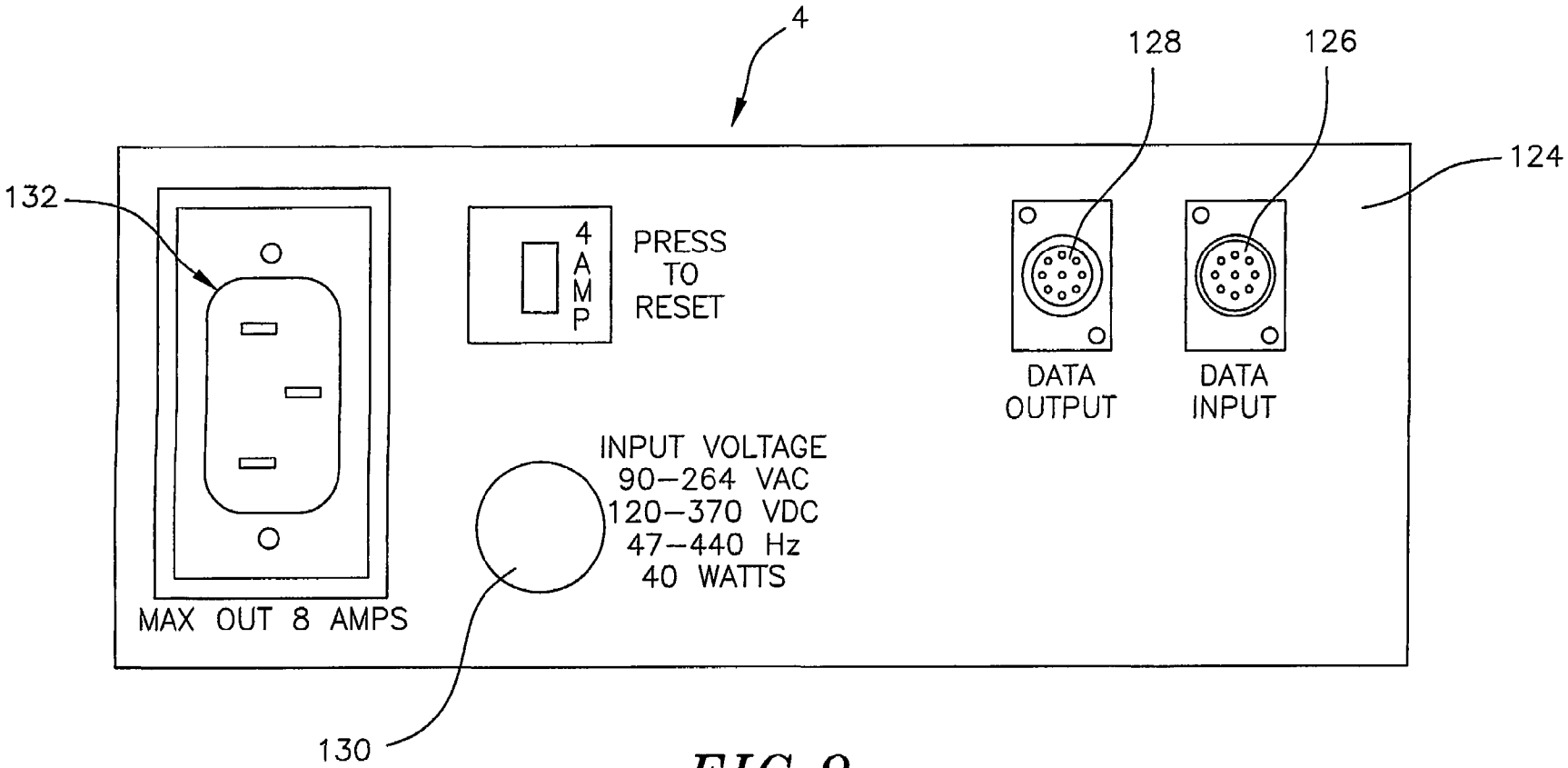
FIG. 9 is a plan view of an exemplary rear panel of the power supply/controller of the present invention.

FIG. 9 shows an exemplary rear face 124 of power supply/controller 4 such as may be employed on housing 20 opposite control panel 18. Rear face 124 includes data input port 126 and data output port 128. Power input port 130 is connected by means of an electrical wire to a 90-264 volt AC wall power source or a 120-370 volt power source. In the exemplary embodiment in which an optional external device, such as a computer, is used to control the LED lighting apparatus, the external device provides such data through data input port 126. A conversor (not shown) may be used as described previously.

According to another exemplary embodiment, ten LED apparatuses may be "piggy-backed." That is, power supply/controllers 4 of the present invention, each coupled to a corresponding LED array 34, may be connected in parallel. The ten parallel power supply/controllers are coupled using data input and data output ports 126 and 128, respectively. Only one connection to a wall power source is needed as each power supply/controller includes electrical jack 132 which provides power and into which the input power connection of another power supply/controller may be inserted. In this manner, only one wall power connection is needed and the input voltage/power is provided to each of the power supply/control units connected in parallel. According to this arrangement, special effects such as flash, flare, lightning, gun flash, fire, light movement across a plane, flick generator effects, and repeatable transitions may be achieved. The multiple LED housings may be arranged in various spatial relationships. According to this exemplary embodiment, one of the power supply/controllers is set in local control mode (master) and used to control all other power supplies/controllers which are set in remote control mode (slaves). According to one exemplary embodiment, multiple LED lighting apparatuses may be connected in parallel and externally controlled via DMX connection using a personal computer or the like.

Figure 10:
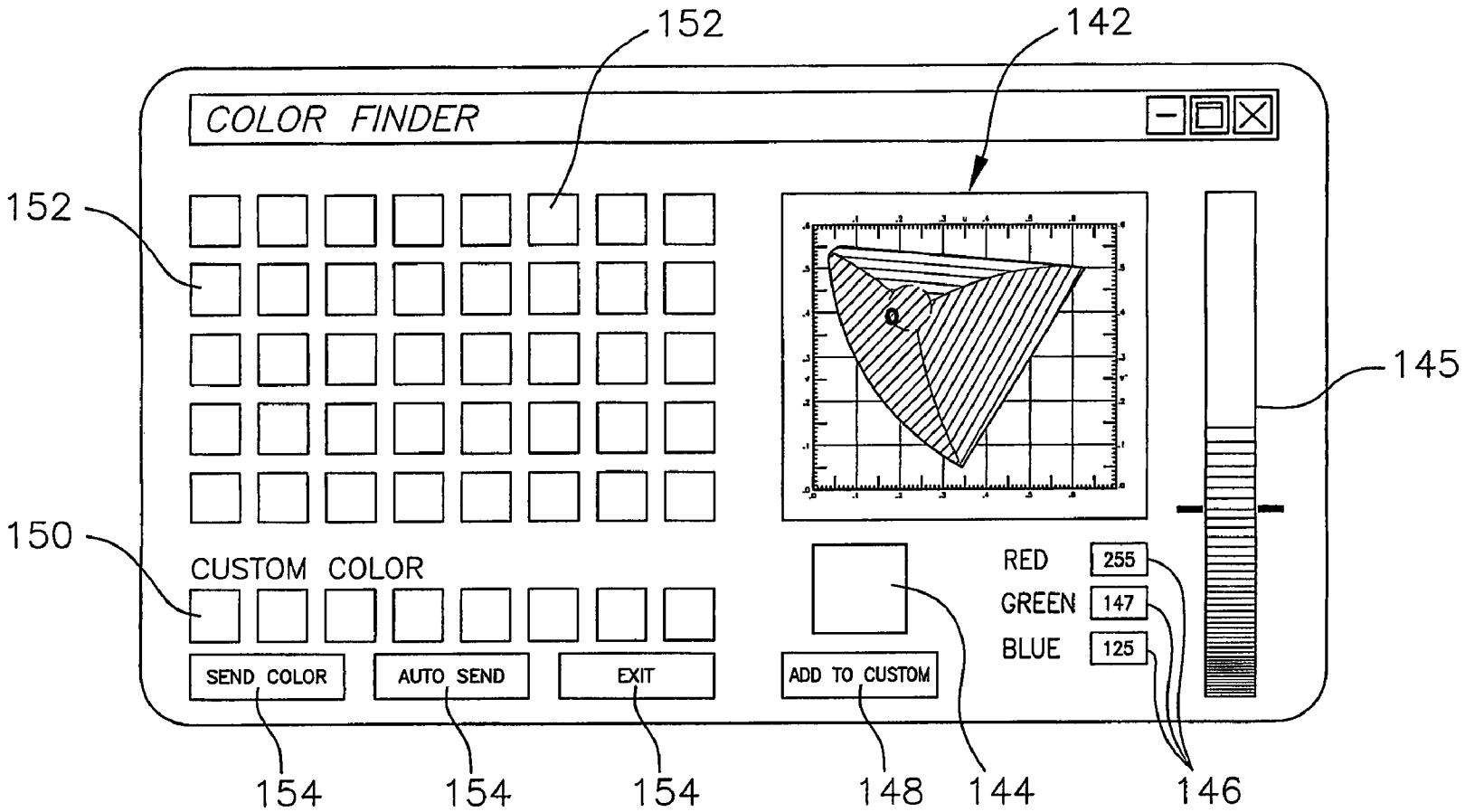
FIG. 10 is a plan view of an exemplary computer screen used to select and control the visible illumination color produced by the LED light source of the present invention.

FIG. 10 shows an exemplary computer screen through which custom colors may be formulated and selected. As described above, an external computer may be used to select colors of illumination in some exemplary embodiments. Computer graphics 140 include exemplary color spectrum pad 142. According to a preferred embodiment, color spectrum pad 142 may be a chromaticity diagram including the primary colors, the secondary colors and the various color temperatures of white light. Color spectrum pad 142 may accommodate the movement of a cursor within the pad such as may be controlled by a mouse. The cursor may then select a color and the selected color is then displayed on display pad 144. Numeric values may alternatively be input into input fields 146 to create and select a color based on the relative intensities (1-256) of red, green and blue light, according to the red/blue/green light embodiment. Using this color selection technique, display pad 144 also displays the created color. The intensity of the selected color of visible illumination (defined by the relative intensities of the respective different colored LEDs) may be adjusted using intensity adjuster 145. Intensity adjuster 145 may be controlled by suitable means, such as by a cursor. Key 148 may be used to add the created color of visible illumination to custom color selectors 150. Computer screen 140 may also include pre-set color selections 152. Control keys 154 may be used to select either of pre-supplied color selections 152 or custom color selections 150 and send a signal representative of such a color to control board 58, which then causes LED array 34 to produce the selected color. The illustrated computer graphics are intended to be exemplary, not restrictive of techniques for formulating and selecting an illumination color to be produced by the LED lighting apparatus. Various software and associated computer graphics may be used to formulate and select a color of illumination.

Figure 11:
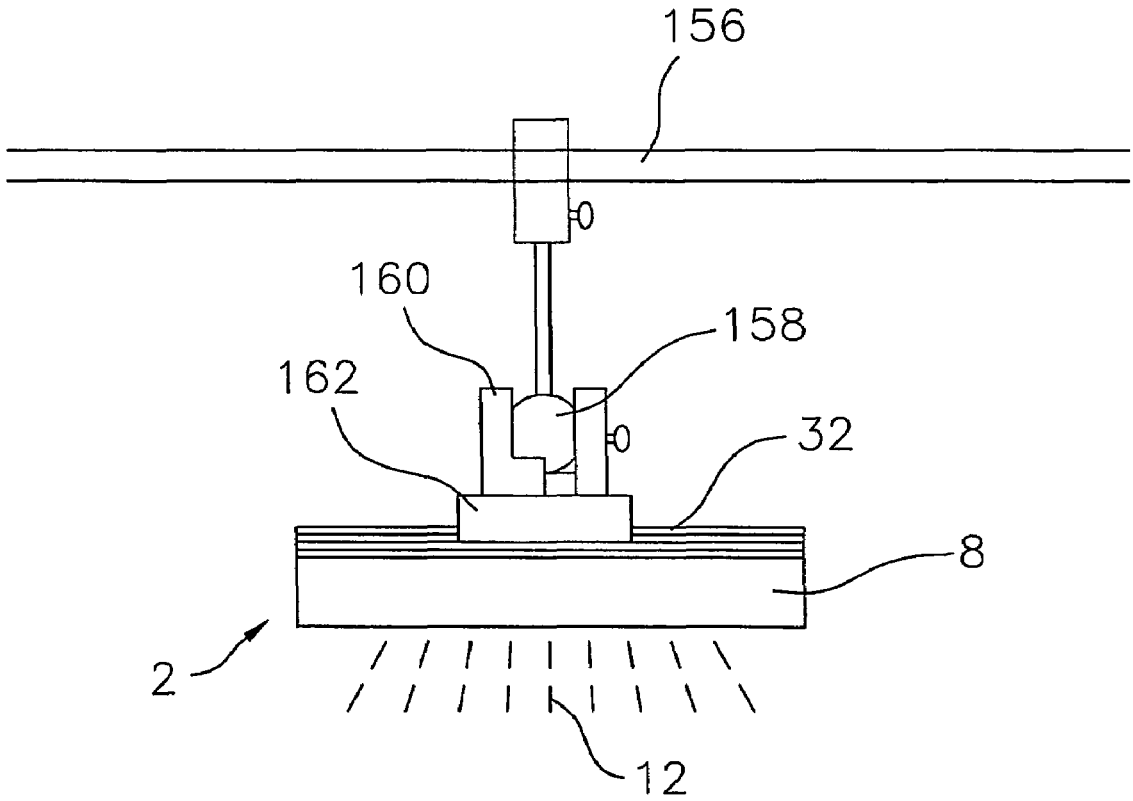
FIG. 11 shows an exemplary LED housing rotatably and slidably coupled to a fixture according to the present invention.

According to another aspects of the present invention, the LED unit of the present invention may be mounted to a fixture such that the LED unit is rotatable and slidable with respect to the fixture. This enables LED units to be used in tight or awkward spaces. FIG. 11 shows LED housing 8 coupled to fixture 156. Fixture 156 may be a post or any other stationary or movable mechanically stable member. In one exemplary embodiment, LED housing 8 may be coupled to fixture 156 including a ball shaft 158 and ball housing 160. Ball housing 160 may be tightened to the ball of ball shaft 158 in place, or it may be loosened to allow LED housing 8 to be positioned by rotating through a full range of motion with respect to fixture 156. In one exemplary embodiment, a mounting structure such as produced by OmniMount Systems, Inc. of Phoenix, Ariz., may be used. Ball housing 160 may be tightened using various conventional mechanical methods, to fix LED housing 8 in position with respect to fixture 156. Ball housing 160 is connected to holder 162, and LED housing 8 is slidable with respect to holder 162, as shown in FIG. 12.

Figure 12:
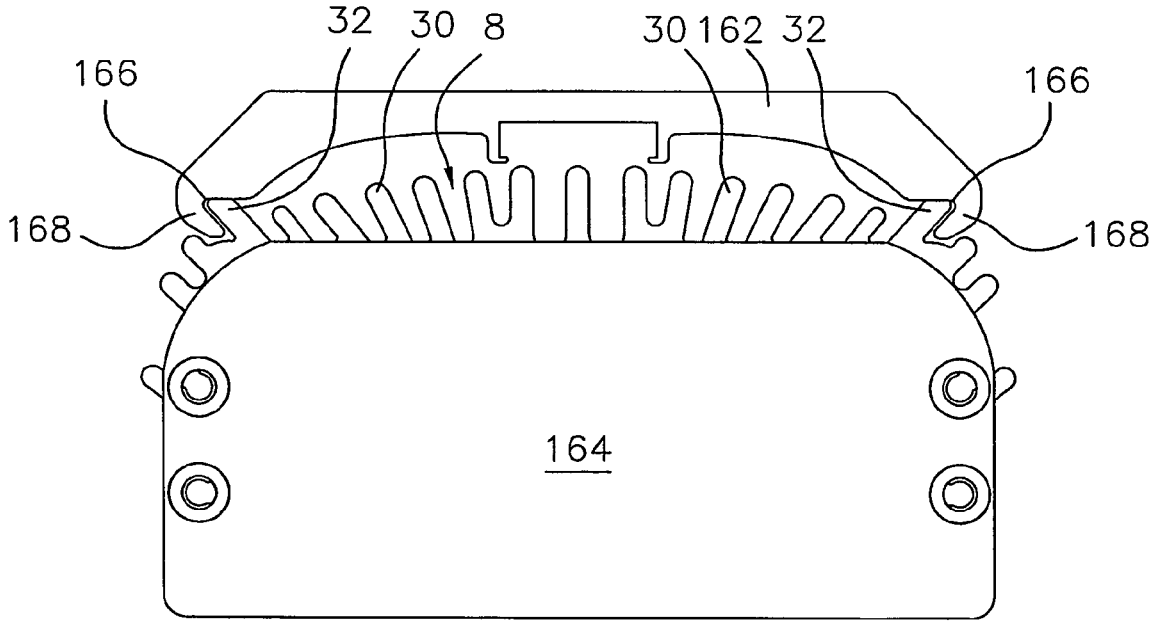
FIG. 12 is an end view showing an LED housing of the present invention coupled to a holder.

FIG. 12 is an end view showing the slidability between LED housing 8 and holder 162. LED housing 8 includes ribs 32 which are received by grooves 166 of holder 162. Grooves 166 are produced by flanges 168 and secure ribs 132 into position but allow for LED housing 8 to slide with respect to holder 162 (in and out of the plane of the illustration of FIG. 12). LED housing 8 includes end plate 164, which secures the LED array (not shown) in place. Various conventional locking mechanisms, such as a brake shoe, are available and may be used to secure holder 162 in fixed position with respect to LED housing 8.

Although heretofore described in conjunction with an LED array formed of red/green/blue LEDs, it is to be understood that the present invention is not intended to be limited to such exemplary embodiments described above. For example, according to the exemplary embodiment which the lighting array of the present invention includes additional LEDs of colors other than red, green and blue, or other light sources, the light sources will be controlled, selected and combined in the same manner as described in conjunction with the red/green/blue LED array embodiment.

Although the invention is described herein with reference to specific embodiments, the invention is not intended to be limited to the details shown and described. Rather, various modifications may be made in the details within the scope and range of equivalents of the claims, and without departing from the invention.

What is claimed is:

1. A lighting apparatus comprising:

a plurality of LEDs defining an array of LEDs including more than one different colored group of LEDs; and an integral power supply/controller unit disposed within a unitary housing and connectible directly between said plurality of LEDs and a power source, and including:

a power supply module for receiving power from a power source and providing modulated power to the plurality of LEDs, a memory device, a user interface capable of providing a plurality of signals, each corresponding to a distinct illumination color of a corresponding plurality of distinct illumination colors, the user interface including a plurality of pre-set buttons each of which is operable to provide one of the signals, a controller for receiving a signal of said plurality of signals from the user interface and communicating with the memory device and the power supply module to substantially instantly cause the plurality of LEDs to produce a first distinct illumination color of said plurality of distinct illumination colors, independent of externally adjustable settings, and a dimmer capable of uniformly dimming the LEDs associated with a distinct illumination color.

2. A lighting apparatus comprising:

a plurality of LEDs defining an array of LEDs including more than one different colored group of LEDs; and an integral power supply/controller unit disposed within a unitary housing and connectible directly between said plurality of LEDs and a power source, and including:

a power supply module for receiving power from a power source and providing modulated power to the plurality of LEDs, a memory device, a user interface capable of providing a plurality of signals each of which corresponds to a distinct illumination color of a corresponding plurality of distinct illumination colors, the user interface including a plurality of pre-set buttons and the plurality of distinct illumination colors including programmed illumination colors each being defined by data stored within the memory device and selectable by a corresponding pre-set button, each programmed illumination color including intensity levels for each of the different colored groups of LEDs, the programmed illumination colors comprising red, blue, green, cyan, yellow, magenta, daylight 5500° K, tungsten 3200° K, and tungsten 2900° K, and a controller for receiving a provided signal from the user interface and communicating with the memory device and the power supply module to substantially instantly cause the plurality of LEDs to produce the distinct illumination color to which the received provided signal corresponds independent of externally adjustable settings.

3. A lighting apparatus comprising:

a plurality of LEDs defining an array of LEDs including more than one different colored group of LEDs; and an integral power supply/controller unit disposed within a unitary housing and connectible directly between said plurality of LEDs and a power source, and including:

a power supply module for receiving power from a power source and providing modulated power to the plurality of LEDs, a memory device, a user interface capable of providing a plurality of signals, each of which corresponds to a distinct illumination color of a corresponding plurality of distinct illumination colors, a controller for receiving a provided signal from the user interface and communicating with the memory device and the power supply module to substantially instantly cause the plurality of LEDs to produce the distinct illumination color to which the received provided signal corresponds independent of externally adjustable settings, and a computer, and in which the user interface provides the plurality of signals responsive to commands from the computer, the computer having graphics including a color spectrum pad that includes primary colors, secondary colors, and a plurality of color temperatures of white light, each color of the color spectrum pad being selectable and provideable to the user interface by way of said commands.

4. A lighting apparatus comprising:

an array of LEDs including a first plurality of first color LEDs, a second plurality of second color LEDs, and a third plurality of third color LEDs; and an integral power supply/controller unit disposed within a unitary housing and connectible to the array of LEDs and a power source, and including:

a power supply module for receiving power from a power source, and providing modulated power to the array of LEDs, a memory device, a user interface capable of providing a plurality of signals each of which corresponds to a distinct illumination color of a corresponding plurality of distinct illumination colors, a controller for receiving a provided signal from the user interface and communicating with the memory unit and the power supply module to instantly cause the array of LEDs to produce the distinct illumination color to which the received provided signal corresponds independent of external settings, and a computer, the controller being capable of receiving commands from the computer and communicating with the power supply module to cause the array of LEDs to produce the plurality of distinct illumination colors, the computer including a color spectrum pad that includes individually selectable colors including primary colors, secondary colors, and a plurality of color temperatures of white light.

5. The lighting apparatus as in claim 4 in which the controller further communicates with the computer using DMX protocol.

6. The lighting apparatus as in claim 4, in which the computer and the controller can communicate using one of RS-485 communication standards and RS-232 communication standards.

* * * * *